US008113921B2

(12) United States Patent
Krauss et al.

(10) Patent No.: US 8,113,921 B2
(45) Date of Patent: Feb. 14, 2012

(54) TOOL SET FOR AN ECCENTRIC GRINDER

(75) Inventors: Bernhard Krauss, Holzgerlingen (DE); Christian Funke, Filderstadt (DE); Heiko Roehm, Stuttgart (DE); Andreas Heber, Filderstadt (DE)

(73) Assignee: Robert Bosch GmbH, Stuttgart (DE)

( * ) Notice: Subject to any disclaimer, the term of this patent is extended or adjusted under 35 U.S.C. 154(b) by 533 days.

(21) Appl. No.: 12/301,081

(22) PCT Filed: Dec. 19, 2007

(86) PCT No.: PCT/EP2007/064154

§ 371 (c)(1),
(2), (4) Date: Nov. 17, 2008

(87) PCT Pub. No.: WO2008/098637

PCT Pub. Date: Aug. 21, 2008

(65) Prior Publication Data

US 2009/0209186 A1 Aug. 20, 2009

(30) Foreign Application Priority Data

Feb. 16, 2007 (DE) ..... 10 2007 007 787

(51) Int. Cl.
*B24B 23/00* (2006.01)

(52) U.S. Cl. ..... 451/357; 451/359; 451/350; 451/548; 451/57

(58) Field of Classification Search ..... 451/548, 451/357, 359, 350, 57–58; 83/174, 174.1
See application file for complete search history.

(56) References Cited

U.S. PATENT DOCUMENTS

| | | | | |
|---|---|---|---|---|
| 2,685,155 | A * | 8/1954 | Kuzma et al. | 451/533 |
| 2,694,886 | A * | 11/1954 | Allison et al. | 451/541 |
| 2,726,495 | A * | 12/1955 | Field | 451/537 |
| 2,919,521 | A * | 1/1960 | Durney | 451/340 |
| 3,885,925 | A * | 5/1975 | Tatar | 451/48 |
| 3,918,216 | A * | 11/1975 | Best et al. | 451/41 |
| 4,052,822 | A * | 10/1977 | Obear | 451/24 |
| 4,436,130 | A * | 3/1984 | Suzuki et al. | 152/525 |
| 4,729,194 | A * | 3/1988 | Maier et al. | 451/357 |
| 4,729,195 | A * | 3/1988 | Berger | 451/357 |
| 4,754,575 | A * | 7/1988 | Schneider | 451/271 |
| 5,020,280 | A * | 6/1991 | O'Reilly | 451/342 |
| 5,167,095 | A * | 12/1992 | Berger | 451/357 |
| 5,332,098 | A * | 7/1994 | Fisher | 206/576 |
| 5,392,566 | A * | 2/1995 | Wedeniwski | 451/5 |
| 5,458,533 | A * | 10/1995 | Barth et al. | 451/357 |
| 6,206,771 | B1 * | 3/2001 | Lehman | 451/357 |
| 6,368,202 | B1 * | 4/2002 | Kaiser | 451/548 |
| 6,454,640 | B1 * | 9/2002 | Siedler et al. | 451/357 |
| 6,494,772 | B1 * | 12/2002 | Barnes et al. | 451/353 |

(Continued)

FOREIGN PATENT DOCUMENTS

CN 1899765 1/2007

(Continued)

*Primary Examiner* — George Nguyen
(74) *Attorney, Agent, or Firm* — Michael J. Striker

(57) ABSTRACT

The invention relates to a grinding disk for an eccentric grinding machine. In order to operate the grinding disk (22) having different disks diameters on one and the same eccentric grinding machine for achieving grinding results at optimum quality, without any loss of smoothness and handling quality, the disk mass of the grinding disk has a fixed predetermined value that is independent of the disk diameter selected.

11 Claims, 2 Drawing Sheets

U.S. PATENT DOCUMENTS

| | | | | |
|---|---|---|---|---|
| 6,905,398 | B2 * | 6/2005 | Jeong | 451/57 |
| 6,974,362 | B2 * | 12/2005 | Lindell et al. | 451/5 |
| 7,153,199 | B1 * | 12/2006 | Decker | 451/343 |
| 2005/0197052 | A1 * | 9/2005 | Lampka et al. | 451/357 |
| 2007/0010179 | A1 * | 1/2007 | Lamprecht | 451/343 |

FOREIGN PATENT DOCUMENTS

| | | |
|---|---|---|
| EP | 0 557 733 | 9/1993 |
| EP | 0 557 773 | 9/1993 |
| WO | 2006/100153 | 9/2006 |

* cited by examiner

TOOL SET FOR AN ECCENTRIC GRINDER

CROSS-REFERENCE

The invention described and claimed hereinbelow is also described in PCT/EP2007/064154, filed on Dec. 19, 2007 and DE 10 2007 007 787.6, filed on Feb. 16, 2007. This German Patent Application, whose subject matter is incorporated here by reference, provides the basis for a claim of priority of invention under 35 U.S.C. 119 (a)-(d).

BACKGROUND OF THE INVENTION

The present invention is directed to a tool set for an eccentric grinder having at least two grinding discs.

A known hand-held sander (U.S. Pat. No. 5,018,314) designed as an eccentric grinder includes a circular grinding disc which is installed via a pivot bearing on an eccentric output shaft of an eccentric gearing driven by an electric motor. The grinding disc includes a support body and a grinding means carrier. The support body of the grinding disc includes a flat plate and a bearing tube which is designed as a single piece with the plate and extends away from the plate at a right angle, and in which the pivot bearing is inserted. The circular grinding means carrier composed of plastic bears in a planar manner against the plate of the support body and extends over the plate of the support body via its appropriately designed edge in the manner of a clip.

A known grinding disc for a hand-held sander (EP 0 557 773 A1) includes a support plate composed of plastic, a cushion foamed onto the support plate as the carrier for a grinding means, and a steel disc located between them, as a reinforcing part. The underside of the cushion forms a flat mounting surface for an abrasive disc and is provided with Velcro strips, to which the velour backing of the abrasive disc adheres. The support plate includes, on its top side which faces away from the sanding cushion, a mounting surface enclosed by a centering ring for placing the grinding disc on an eccentrically driven driving element of an eccentric grinder.

To ensure that there is satisfactory running smoothness of the eccentric grinder, the eccentric component mass of the grinding disc is stabilized in a static and dynamic manner by at least one balancing mass attached to the output shaft of the electric motor. Since the magnitude of the balancing mass is matched to the mass of the grinding disc, only a certain single grinding disc may ever be used with the eccentric grinder.

SUMMARY OF THE INVENTION

The tool set according to the present invention—for an eccentric grinder has the advantage that, given that the disc mass has a fixedly specified value which is independent of the disc diameter that was selected, the grinding disc may be designed with different diameters in order to attain top-quality grinding results, and the grinding disc may be operated with the same eccentric grinder without this having a negative effect on the running smoothness of the machine. For example, it is possible to use a grinding disc with a disc diameter of 150 mm to grind large surface areas, and to use a grinding disc with a disc diameter of 125 mm to grind corners and concave surfaces in the same eccentric grinder. This provides customers with the advantage that they may use an entire set of grinding discs with the same eccentric grinder, the grinding discs having disc diameters which are specially adapted to the type of grinding work to be performed, while the machine maintains its same good handling quality at all times.

The value of the disc mass, which is fixedly specified by the balancing mass in the eccentric grinder, may be adhered to in different manners, independently of the disc diameter, e.g., according to an advantageous embodiment of the present invention, by designing the grinding disc with a height that is inversely proportional to the disc diameter, i.e., when the disc is manufactured with a large disc diameter, the disc height is made correspondingly small, and, conversely, when the grinding disc is manufactured with a small diameter, the disc height is made much greater.

According to an advantageous embodiment of the present invention, the grinding disc is composed of at least two components, a carrier plate for placement of the grinding disc on the eccentric of the eccentric grinder, and a sanding cushion fastened to the carrier plate with a supporting surface for a detachably connected abrasive disc. In this embodiment of the grinding disc, the specified value of the disc mass may be adhered to, independently of the disc diameter, by the fact that the density of the carrier plate material and/or the sanding cushion material are/is inversely proportional to the magnitude of the disc diameter. The grinding disc with a large diameter therefore has a grinding disc material with a lower density, and the grinding disc designed with a small disc diameter has a very large density.

According to an advantageous embodiment of the present invention, the fixedly specified value may also be adhered to, independently of the disc diameter, via various selections of the material of which the carrier plate and/or sanding cushion are/is composed. For example, a hard plastic may be used as the material for the carrier plate, and a plastic foam may be used for the sanding cushion, the density of the hard plastic being adapted to the disc diameter. As an alternative, it is possible to embed a metal ply in the hard plastic, the mass of which is inversely proportional to the magnitude of the disc diameter.

BRIEF DESCRIPTION OF THE DRAWING

The present invention is described in greater detail in the description below with reference to an embodiment shown in the drawing.

FIG. 1 shows a section, in a partial cross-sectional side view, of a hand-guided eccentric grinder which is referred to below as an eccentric sander, for performing grinding work. The eccentric sander includes a housing 11 which transitions into a handle 12 toward the left as shown in the illustration, on the underside of which a switch 13 is located for switching an electric motor 14 located inside housing 11 on and off. A wheel 16 of a suction fan is non-rotatably mounted on output shaft 15 of electric motor 14, with which the sanding dust produced on the surface of a work piece during sanding work is suctioned up and transported via a blow-out connector 17 into a dust collection container. An eccentric recess 18 is provided in the hub of wheel 16, which is penetrated by a driving element 19 which extends away from the underside of housing 11, driving element 19 bearing via two roller bearings 20, 21 against the inner wall of eccentric recess 18. Driving element 19 is driven in a rotating manner via roller bearings 20, 21, depending on the bearing friction. Roller bearings 20, 21 and driving element 19 are retained in eccentric recess 18 in an axially non-displaceable manner.

Figure 1:
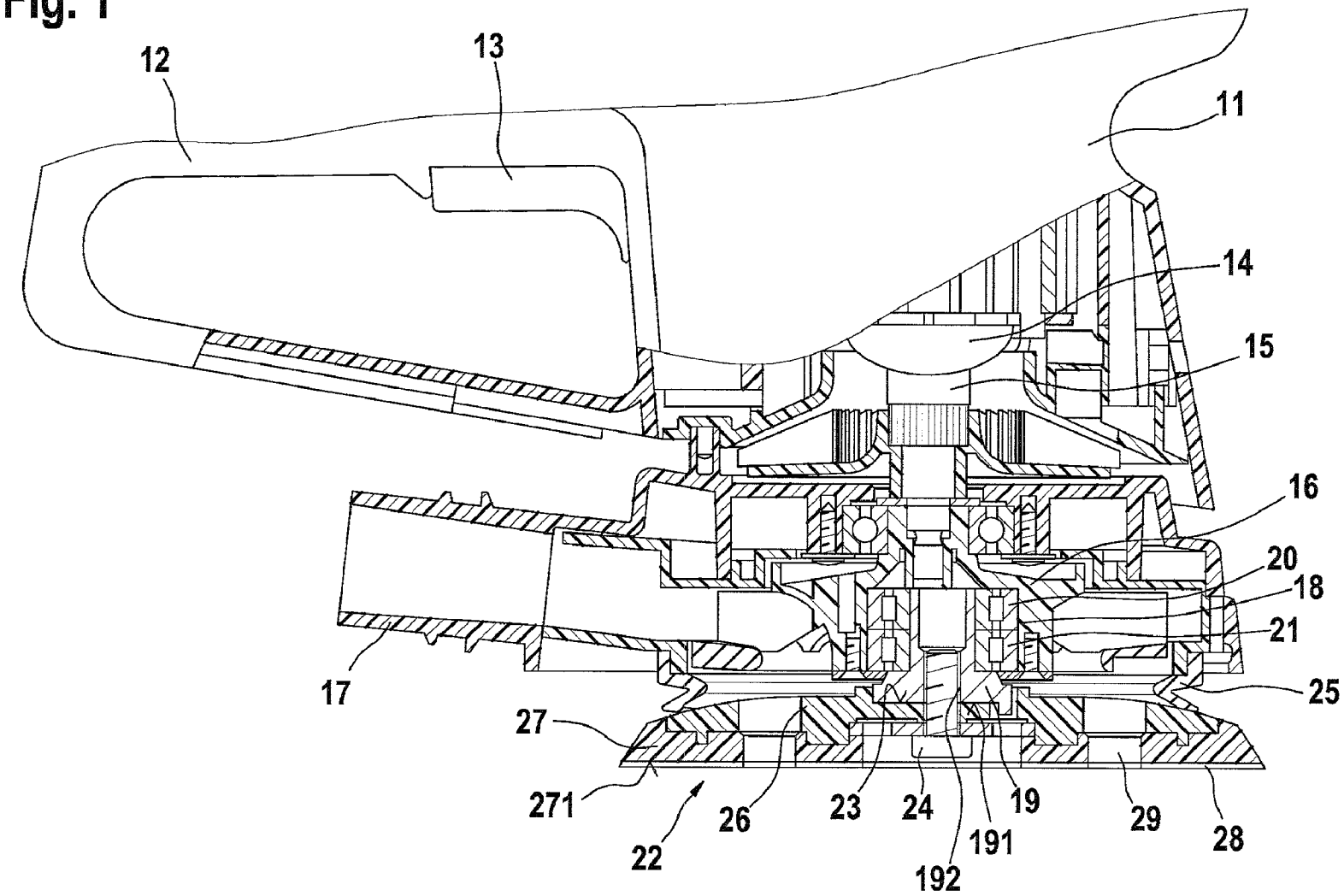
FIG. 1 is a partial side view of an eccentric sander with a replaceable grinding disc, shown in a partial cross-sectional view.

A flat supporting surface 191 is formed on the underside of driving element 19, on which a grinding disc 22 may be placed via a mounting surface 23 formed on its top side. The connection between grinding disc 22 and driving element 19 takes place via at least one cap screw 24, which may be screwed into at least one axial borehole 192 formed in driving element 19. A disc brake 25 composed of rubber is non-rotatably fastened to the underside of housing 11. Disc brake 25 lies on the top side of grinding disc 22.

Grinding disc 22 is composed of two components, a carrier plate 26 made of a hard plastic, and a sanding cushion 27 fastened to the underside of carrier plate 26. Mounting surface 23 of grinding disc 22 is designed such that it is centered on carrier plate 26. A supporting surface 271 for an abrasive disc (not depicted) is formed on the underside of sanding cushion 27 which faces away from carrier plate 26. Supporting surface 271 includes a Velcro layer for fastening with the abrasive disc which has a velour backing. The Velcro layer is eliminated when self-adhesive sanding paper is used. Dust collection ports 29 which pass through carrier plate 26 and sanding cushion 27 are provided in grinding disc 22, via which the sanding dust is suctioned into a dust collection chamber which is formed in housing 11 and connected to blow-out connector 17, and in which wheel 16 rotates. To obtain a satisfactory running smoothness of the eccentric grinder, at least one balancing weight (not depicted) acts on output shaft 15 of electric motor 14. The balancing weight neutralizes the eccentric mass of grinding disc 22 in a static and dynamic manner. The balancing weight may be realized, e.g., via a corresponding design of wheel 16 of the suction fan. The sum of the masses of the balancing weights that are present is referred to below as the balancing mass.

To attain top-quality sanding results when working with various work piece surfaces, it is advantageous to use grinding discs having grinding surfaces of different sizes, i.e., disc diameters of different sizes. For example, it is recommended to use a grinding disc with a disc diameter of 150 mm to grind large, flat work piece surfaces, and to use a grinding disc with a disc diameter of 125 mm to grind corners and concave surfaces. To be able to use grinding discs with such different disc diameters with the eccentric grinder shown in FIG. 1 without altering the handling quality of the eccentric grinder—its running smoothness in particular—the disc mass of each grinding disc 22 has a fixedly specified value which is independent of the selected disc diameter. This value is specified by the balancing mass present in the eccentric grinder, which is matched to the imbalance-free operation of the eccentric grinder with a selected grinding disc 22 which is fastened to its driving element 19 and is covered with an abrasive disc. Grinding disc 22 is designed in a manner such that its center of mass lies on the disc axis at a comparable distance from mounting surface 23, which is independent of the disc dimensions, i.e., the eccentric grinder always sees the same mass with a center of mass located in the same position, regardless of which grinding disc with which disc diameter is fastened to driving element 19.

Figure 2:
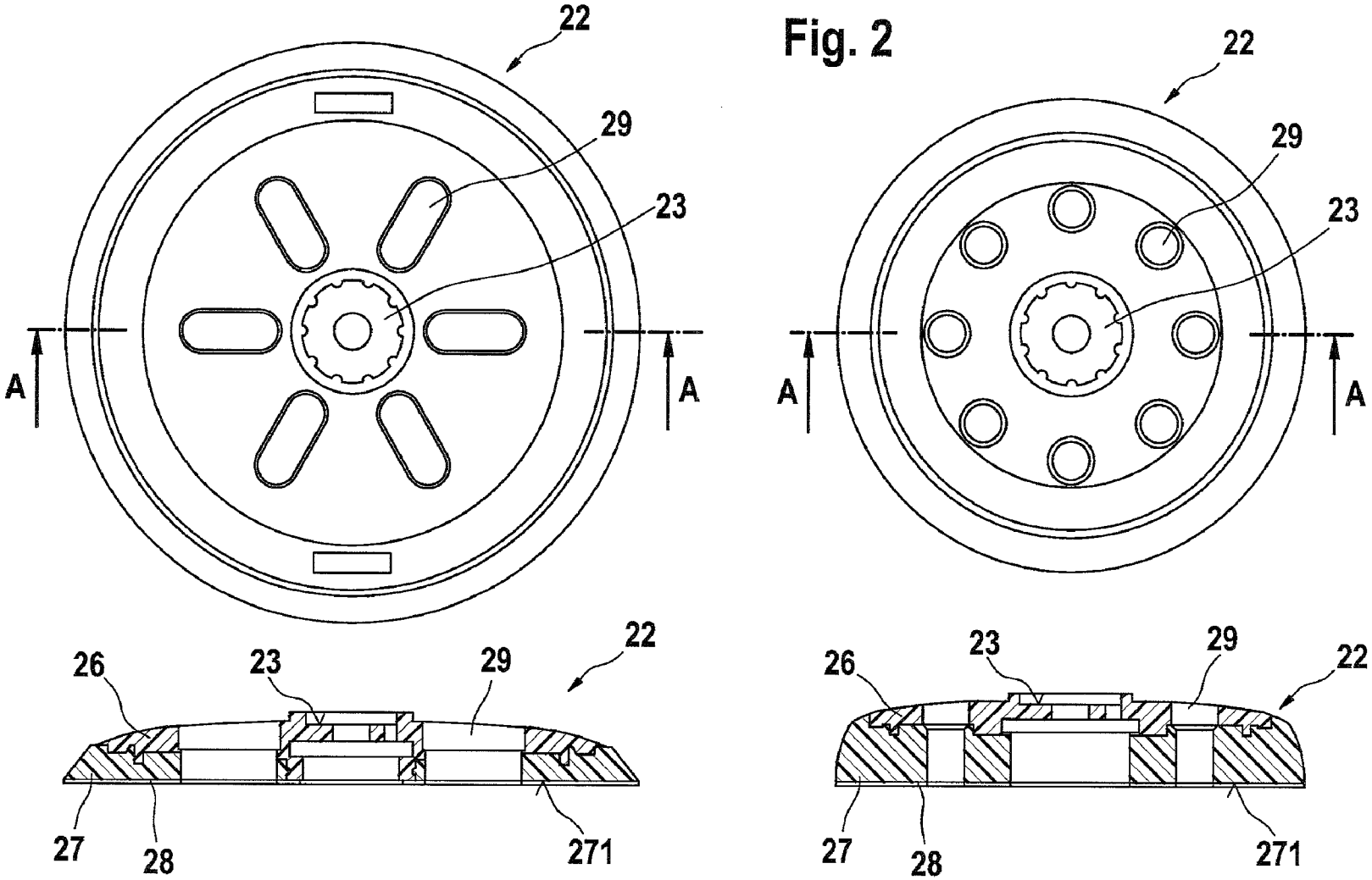
FIG. 2 shows a tool set of two sanding discs—shown in a top view and in a sectional view along line A-A—with different diameters for the eccentric grinder in FIG. 1.

Various design-related measures are implemented individually or in combination in order to hold the disc mass of grinding disc 22 shown in FIG. 2 constant, grinding disc 22 belonging to the tool set for the eccentric grinder shown in FIG. 1. For example, grinding discs 22 are manufactured in a manner such that the distance between mounting surface 23 and abrasive disc supporting surface 271 is inversely proportional to the disc diameter. As a result, grinding disc 22 which is shown on the left in FIG. 2 and has the larger disc diameter has a markedly smaller axial disc height than does grinding disc 22 which is shown on the right in FIG. 2 and has the smaller disc diameter. In addition or as an alternative thereto, the density of the material of carrier plates 26 is also inversely proportional to the magnitude of the disc diameter. For example, grinding disc 22 which is shown on the left in FIG. 2 and has the larger disc diameter has a markedly smaller density than does the carrier plate material of the grinding disc which is shown on the right in FIG. 2 and has the smaller disc diameter.

Carrier plate 26 of both grinding discs 22 is preferably made of hard plastic, and the density of the plastic material in both grinding discs 22 is selected to be equal, or the density of the hard plastic in grinding disc 22 with the larger diameter is selected to be smaller than the density of the hard plastic in grinding disc 22 with the smaller diameter. In the latter case, the material for sanding cushion 27 in both grinding discs 22 is made of plastic foam.

Although this is not depicted, a metal ply may be embedded in carrier plate 26—which is composed of hard plastic—of each grinding disc 22. The magnitude of the metal ply is inversely proportional to the magnitude of the disc diameter. For example, the material ply in grinding disc 22 which is shown on the right in FIG. 2 and has the smaller diameter has a much larger mass than does the metal ply in grinding disc 22 which is shown on the left in FIG. 2 and has a larger diameter.

In the two grinding discs 22 shown in FIG. 2, mounting surface 23 for placement of grinding disc 22 on supporting surface 191 of driving element 19 have the identical design. Dust collection ports 29 are adapted to the hole pattern of the abrasive disc specified for the disc diameter. Since the abrasive discs used in conjunction with grinding disc 22 having the larger diameter include a hole pattern with a total of six round holes, grinding disc 22 with the larger diameter therefore includes six oval dust collection ports 29 which are offset relative to each other by the same circumferential angle as are the abrasive disc holes, while sanding disc 22 with the smaller diameter includes a total of eight dust collection ports 29 with circular cross sections, which are distributed equally on a hole circle, in accordance with the hole pattern of the prescribed abrasive discs.

What is claimed is:

1. A tool set for an eccentric grinder, comprising at least two grinding discs, wherein said at least two grinding discs have unequal disc diameters, and said at least two grinding discs have substantially equal masses, so that a mass of each of said grinding discs is independent of a diameter of each of said grinding discs, to provide an imbalance-free operation of the eccentric grinder, regardless of which of said at least two grinding discs is fastened to a driving element of the eccentric grinder.

2. A tool set for an eccentric grinder as defined in claim 1, wherein each of said grinding discs consists of a carrier plate with a top side provided with a mounting surface, and a sanding cushion fastened to an underside of said carrier plate and having an abrasive disc supporting surface formed on an underside of said sanding cushion, wherein said carrier plate with said sanding cushion of one of said at least two grinding discs has a mass which is substantially equal to a mass of said carrier plate with said sanding cushion of the other of said at least two grinding discs.

3. A tool set for an eccentric grinder as defined in claim 2, wherein said mounting surface of said carrier plate of one of said at least two grinding discs is identical to said mounting surface of the other of said at least two grinding discs, so that each of said grinding discs is mountable on the same driving element of the same eccentric grinder.

4. A tool set for an eccentric grinder as defined in claim 1, wherein each of said at least two grinding discs includes an abrasive disc supporting surface formed on an underside, and a mounting surface formed on a top side for placement on an eccentrically driven driving element of the eccentric grinder, wherein a center of mass of each of said at least two grinding discs lying on a disc axis has an axial distance from said mounting surface, which is substantially equal for both said at least two grinding discs.

5. A tool set for an eccentric grinder as defined in claim 4, wherein the distance between said mounting surface and said abrasive disc supporting surface in one of said at least two grinding discs which has a greater disc diameter is smaller than in the other of said at least two grinding discs which has a smaller disc diameter.

6. A tool set for an eccentric grinder as defined in claim 3, wherein a material selected from the group consisting of a material of said carrier plate, a material of said sanding cushion and both has a density which is smaller than in one of said two grinding discs having a greater diameter than in the other of said grinding discs having a smaller diameter.

7. A tool set for an eccentric grinder as defined in claim 3, wherein said carrier plate of each of said grinding discs is composed of a hard plastic in which a metal ply is embedded, and wherein a mass of said metal ply of one of said grinding discs having a larger disc diameter is smaller than in the other of said grinding discs having a smaller disc diameter.

8. A tool set for an eccentric grinder as defined in claim 3, wherein said mounting surfaces of said at least two grinding discs have identical shapes and sizes.

9. A tool set for an eccentric grinder as defined in claim 1, wherein one of said at least two grinding discs has a larger diameter than the other of said two grinding discs, wherein said one of said grinding discs with said larger diameter has a smaller axial disc height than the other of said grinding discs having said smaller disc diameter.

10. A tool set for an eccentric grinder as defined in claim 2, wherein one of said at least two grinding discs has a larger diameter than the other of said two grinding discs, and when a distance between said mounting surface and said abrasive disc supporting surface in said one grinding disc with the larger disc diameter is smaller than a distance between said mounting surface and said abrasive disc supporting surface in the other of said grinding discs having the smaller disc diameter.

11. A tool set for an eccentric grinder as defined in claim 2, wherein one of said at least two grinding discs has a larger diameter and the other of said grinding discs have a smaller diameter, and wherein an element selected from the group consisting of said carrier plate, said sanding cushion, and both in said grinding disc with the larger disc diameter is smaller than a density of the material of said element in the other grinding disc having the smaller disc diameter.

* * * * *